US012345482B2

(12) United States Patent
Blomgren

(10) Patent No.: US 12,345,482 B2
(45) Date of Patent: Jul. 1, 2025

(54) TUBE HEAT EXCHANGER

(71) Applicant: Marinnovation HB, Falsterbo (SE)

(72) Inventor: Ralf Blomgren, Falsterbo (SE)

(73) Assignee: Marinnovation HB, Falsterbo (SE)

( * ) Notice: Subject to any disclaimer, the term of this patent is extended or adjusted under 35 U.S.C. 154(b) by 180 days.

(21) Appl. No.: 18/261,049

(22) PCT Filed: Dec. 2, 2021

(86) PCT No.: PCT/EP2021/083883
§ 371 (c)(1),
(2) Date: Jul. 11, 2023

(87) PCT Pub. No.: WO2022/156946
PCT Pub. Date: Jul. 28, 2022

(65) Prior Publication Data

US 2024/0060732 A1 Feb. 22, 2024

(30) Foreign Application Priority Data

Jan. 20, 2021 (SE) ..... 2150054-1

(51) Int. Cl.
*F28D 7/16* (2006.01)
*F28D 9/00* (2006.01)
(Continued)

(52) U.S. Cl.
CPC ..... *F28F 9/22* (2013.01); *F28D 7/1676* (2013.01); *F28D 9/005* (2013.01); *F28F 1/40* (2013.01)

(58) Field of Classification Search
CPC .. F28F 9/22; F28D 7/16; F28D 7/1676; F28D 7/1669
See application file for complete search history.

(56) References Cited

U.S. PATENT DOCUMENTS 1,672,650 A 6/1928 Lonsdale
1,790,828 A 2/1931 McKnight
(Continued)

FOREIGN PATENT DOCUMENTS

CN 103954153 A 7/2014
GB 897593 A * 2/1960
(Continued)

*Primary Examiner* — Eric S Ruppert
(74) *Attorney, Agent, or Firm* — Capitol City TechLaw

(57) ABSTRACT

A tube heat exchanger for exchanging heat from a first fluid to a second fluid, comprising a tubular shell; an inner wall extending around a center axis of said tubular shell and forming a central chamber internally of said inner wall, and an annular heat exchange space extending externally of said inner wall and enclosed by said tubular shell, wherein the heat exchange space comprises a plurality of axially extending heat exchange sectors separated by radially extending separating walls, and flow paths of the first fluid and the second fluid extend in the heat exchange space, wherein adjacent heat exchange sectors communicate; and a set of flow tubes extending axially in each of said heat exchange sectors in said heat exchange space. At least one radially extending baffle is provided to divide said heat exchange sectors into at least two axially displaced heat exchange segments, wherein a flow path of the second fluid extends radially in opposite directions in adjacent heat exchange segments in the heat exchange sectors, and a flow path of the first fluid extends perpendicular to the flow path of the second fluid.

16 Claims, 10 Drawing Sheets

(51) Int. Cl.
*F28F 1/40* (2006.01)
*F28F 9/22* (2006.01)

(56) References Cited

U.S. PATENT DOCUMENTS

| | | | |
|---|---|---|---|
| 3,741,167 | A | 6/1973 | Polcer et al. |
| 3,958,630 | A | 5/1976 | Smith |
| 5,291,944 | A | 3/1994 | Sanz et al. |
| 2007/0023173 | A1 | 2/2007 | Nelson et al. |

FOREIGN PATENT DOCUMENTS

| | | | |
|---|---|---|---|
| GB | 865997 | A | 4/1961 |
| JP | S62118987 | U | 7/1987 |
| JP | 2014196895 | A | 10/2014 |
| WO | 8702763 | A1 | 5/1987 |

* cited by examiner

TUBE HEAT EXCHANGER

This application claims priority under 35 USC 119 (a)-(d) to SE patent application No. 2150054-1, which was filed on Jan. 20, 2021, the entire contents of which are incorporated herein by reference.

TECHNICAL FIELD

The present invention relates to heat exchangers in general and tube heat exchangers in particular.

BACKGROUND

Tube heat exchangers are very common in industry and have a very long history. The basic concept has remained substantially unchanged over many years. However, as compared to other types of heat exchangers, tube heat exchangers are comparatively expensive, space requiring and not specifically efficient for heat recovery.

Two fluids, of different starting temperatures, flow through the heat exchanger. One flows through the tubes (the tube side) and the other flows outside the tubes but inside the tubular shell (the shell side). Heat is transferred from one fluid to the other through the tube walls, either from tube side to shell side or vice versa. The fluids can be either liquids or gases on either the shell or the tube side. If energy transferred to the cooling fluid should be utilized it is an advantage if flow paths are long and a flow arrangement is counter current flow. In this way, waste heat can be used efficiently.

In order to obtain an efficient utilization of the energy in the cooling fluid heat exchangers must have a long thermal length. For current types of tube heat exchangers this means the length of the tubes has to be very long.

Presently, tube heat exchangers are big, normally bigger than many other types of heat exchangers designed for the same load. Most tube heat exchangers are mounted with the tubular shell extending horizontally which will make them occupy a considerable area. Furthermore, they will require a service area almost as large as the tube heat exchanger. If a tube inside the tubular shell has to be exchanged it has to be withdrawn in an axial direction, which implicates that there needs to be an open space in the longitudinal extension of the tube heat exchanger, the length of the open space corresponding to the length of the tubes.

The structure of tube heat exchangers makes them sensitive to quick temperature changes, specifically heat exchangers using U-tubes. Several parts of the structure will be affected by an incoming as well an outgoing flow, one of which is hot and one cold. Such conditions can create tensions that may lead to defects or fractures in material during cyclic journal operation.

In a basic structure of a tube heat exchanger cooling of high pressure gas, the gas is directed through a bundle of tubes with a circular cross section. The bundle is provided within a tubular shell or a sheet casing. A circular cross section is optimal regarding the pressure. A flow of a cooling fluid circulates within the tubular shell. Different parts of the heat exchanger, such as tube plates, are exposed to the same pressure as the tubes. Therefore, the tube plates must be thick or as an alternative, the heat exchanger must be designed with a small diameter and have an extended length. Normally, the heat exchangers are designed with a small diameter and extended length which is a cost-effective solution. A working pressure of the cooling fluid within the tubular shell is considerably lower than the pressure of the gas. The tubular shell thickness normally is dimensioned based on the pressure of the cooling fluid, so as to keep costs as low as possible.

Should one or more tubes burst gas will enter a space inside the tubular shell. The pressure in this area will increase and if no outlets are provided also the tubular shell will burst. Since this course of events must be considered the tubular shell is provided with large openings to prevent that very high-pressure conditions arise within the tubular shell. During normal conditions, the large openings are closed by lids. The lids are designed to open or burst at a pressure level somewhat higher than the highest working pressure normally occurring within the tubular shell. This way bursting of the tubular shell can be prevented. As the tube heat exchangers normally are extended in length and have a small diameter they must be provided with a plurality of openings. As a result, the costs will increase. The openings are arranged to allow the gas to exit horizontally which call for a safety area around the heat exchanger where specific restrictions apply. Thus, the area that needs to be reserved for prior art tube heat exchangers is around five to ten times as large as the area of the tube heat exchanger as projected on the underlying ground. Since a normal length of an industrial tube heat exchanger can be 10-15 m, the total required area will become very large.

From the above it is understood that there is room for improvements and the invention aims to solve or at least mitigate the above and other problems.

SUMMARY

The invention is defined by the appended independent claims. Additional features and advantages of the concepts disclosed herein are set forth in the description which follows, and in part will be obvious from the description, or may be learned by practice of the described technologies. The features and advantages of the concepts may be realized and obtained by means of the instruments and combinations particularly pointed out in the appended claims. These and other features of the described technologies will become more fully apparent from the following description and appended claims, or may be learned by the practice of the disclosed concepts as set forth herein.

A tube heat exchanger disclosed herein is suitable for cooling and heating of gas at high pressures. In various embodiments, it can be designed with a compact footprint. In various embodiments, the thermal length of the disclosed tube heat exchanger is long, and the thermal fatigue resistance is high. It is possible to design the heat exchanger with comparatively thin tube plates and closing covers.

One application of the disclosed tube heat exchanger is cooling of gas at very high pressures. In industrial applications, large heat exchangers can be produced at reasonable costs without lower standards of safety.

In various embodiments, the disclosed tube heat exchanger is provided with an annular heat exchange space with a tube package arranged as an annular bundle of tubes. A tubular shell encloses the tubes, and a central chamber is provided in a space within the annular heat exchange space. The central chamber is connected to an outlet tube at one end of tubular shell for outlet of gas at high pressures. The annular shape of the bundle of tubes and an inner wall that enables leaking gas to flow radially from a cracked tube into the central chamber provide for a short distance from a tube fracture to the chamber. As a result, even at a large gas leak gas can be evacuated from the heat exchanger without a substantial risk of a gas pressure that is large enough to cause a rupture of the tubular shell.

The annular heat exchange shape also results in annular tube plates with a width that is much smaller than the tube plate diameter of a tube heat exchanger with circular tube plates having the same tube plate area which further decreases the requirements on the thickness of the tube plates. In the case of a rupture, gas will be directed out from the tube heat exchanger through said outlet tube. In various embodiments, the tube heat exchanger is mounted with the tubular shell oriented vertically. As a result, gas will flow straight upwards. The disclosed tube heat exchanger does not require a safety zone, and there is no need for a specific service area, because the tubes that are used are comparatively short and normally can be pulled out upwards. The area that must be reserved for the disclosed tube heat exchanger corresponds to the area that is projected on the underlying ground.

Another advantage with a heat exchange space with the annular tube package in accordance with the disclosed tube heat exchanger is that the tube plates and closing covers can be made considerably thinner than the tube plates and closing covers of conventional tube heat exchangers with the same cross sectional area of the tube package. One reason for this is that the width of the tube package will be much smaller than the diameter of a traditional tube package. Another reason is that it is possible to use a larger number of, but considerably smaller bolts arranged in one inner circle of bolts and one outer circle of bolts. Using smaller bolts will result in a shorter distance between the inner circle of bolts and the outer circle of bolts, and consequently in a lower bending moment in tube plates and closing covers. If the same cross sectional area of the tube package is maintained the thickness of an annular tube plate can be approximately one fourth of the thickness of a traditional tube heat exchanger.

A traditional tube heat exchanger that can be used for cooling down gas at high pressure, such as several hundreds of bars or tenths of megapascals, can be designed with a diameter of the tube package of up to 1 m, and a thickness of the tube plates of several hundreds of millimeters. In a disclosed type of a tube heat exchanger, the width of the annular tube package of less than one third of said diameter.

By using an annular tube package, it is possible to obtain a heat exchanger with large thermal length without using extremely long tubes. This structure will allow a tube package divided into several sectors with tubes connected in series. As a result, an annular tube heat exchanger can have a very compact design even though it will provide a long thermal length.

In various embodiments, the sectors are divided by baffles into axially displaced segments. A flow path of the cooling fluid will be directed by the baffles and will extend radially in opposite directions in adjacent heat exchange segments.

In various embodiments, the flow of at least one fluid is divided into two separate flows that are directed through two flow paths from an inlet to an outlet. Preferably, the flows of both fluids are divided into two separate flows that are directed through two flow paths from an inlet to an outlet. As a result, there will be a more gradual variation in temperature in the material, and stress in the material can be limited.

In a first aspect, there is disclosed a tube heat exchanger for exchanging heat from a first fluid to a second fluid, comprising a tubular shell;

an inner wall extending around a center axis of said tubular shell and forming a central chamber internally of said inner wall, and an annular heat exchange space extending externally of said inner wall and enclosed by said tubular shell, wherein the heat exchange space comprises a plurality of axially extending heat exchange sectors separated by radially extending separating walls, and flow paths of the first fluid and the second fluid extend in the heat exchange space, wherein adjacent heat exchange sectors communicate;

a set of flow tubes extending axially in each of said heat exchange sectors in said heat exchange space;

a first connection for inlet of the first fluid to a first set of flow tubes, and a second connection for outlet of said first fluid;

at least one radially extending baffle dividing said heat exchange sectors into at least two axially displaced heat exchange segments, wherein the central chamber communicates with at least one opening in a tubeplate, and wherein a flow passage is provided between adjacent heat exchange segments to provide a flow path of the second fluid in a vertical direction between the adjacent heat exchange segments;

a third connection for inlet of the second fluid to a first heat segment of a heat exchange sector, and a fourth connection for outlet of said second fluid;

wherein a first flow path of said first fluid and a second flow path of said second fluid are divided to flow by a first portion clockwise and a second portion anticlockwise through the axially extending heat exchange sectors.

wherein a flow path of the second fluid extends radially in opposite directions in adjacent heat exchange segments in the heat exchange sectors, and a flow path of the first fluid extends perpendicular to the flow path of the second fluid.

BRIEF DESCRIPTION OF THE DRAWINGS

In order to best describe the manner in which the above-described embodiments are implemented, as well as define other advantages and features of the disclosure, a more particular description is provided below and is illustrated in the appended drawings. Understanding that these drawings depict only exemplary embodiments of the invention and are not therefore to be considered to be limiting in scope, the examples will be described and explained with additional specificity and detail through the use of the accompanying drawings in which.

Further, in the figures like reference characters designate like or corresponding parts throughout the several figures.

DETAILED DESCRIPTION

Various embodiments of the disclosed methods and arrangements are discussed in detail below. While specific implementations are discussed, it should be understood that this is done for illustration purposes only. A person skilled in the relevant art will recognize that other components, configurations, and steps may be used without parting from the spirit and scope of the disclosure.

In the description and claims the word "comprise" and variations of the word, such as "comprising" and "comprises", does not exclude other elements or steps.

Hereinafter, certain embodiments will be described more fully with reference to the accompanying drawings. It will be apparent to those skilled in the art that various modifications and variations can be made without departing from the inventive concept. Other embodiments will be apparent to those skilled in the art from consideration of the specification and practice disclosed herein. The embodiments herein are provided by way of example so that this disclosure will be thorough and complete, and will fully convey the scope of the inventive concept, and that the claims be construed as encompassing all equivalents of the present inventive concept which are apparent to those skilled in the art to which the inventive concept pertains. If nothing else is stated, different embodiments may be combined with each other.

The embodiment shown in the figures relates to a heat exchanger 1 for a gaseous first fluid at high pressure using a liquid cooling fluid at low pressure.

Figure 1:
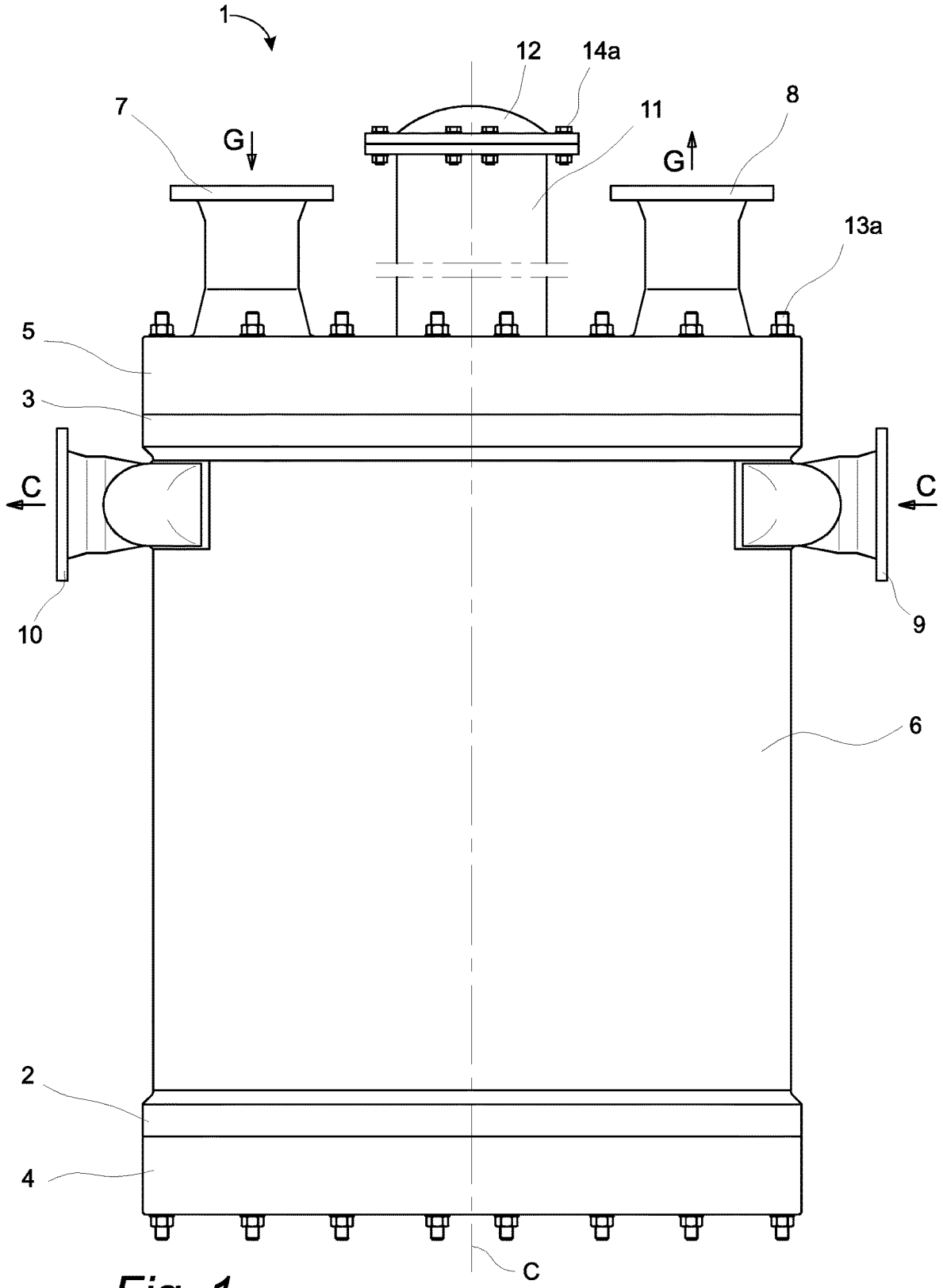
FIG. 1 is a side elevation view of a tube heat exchanger in accordance with a first embodiment.

FIG. 1 shows the tube heat exchanger from one side with a tubular shell 6 extending in a vertical direction. This is a preferred orientation of the tube heat exchanger 1 in use. All references to "upper" and "lower" are made in view of this orientation. In other orientations, "upper" and "lower" refer to opposite axial ends of tube heat exchanger. The tubular shell 6 is provided at a first end with a first annular tube plate 2 and at a second end with a second annular tube plate 3. In various embodiments the first tube plate 2 is a lower annular tube plate and the second tube plate 3 is an upper annular tube plate. A first or lower annular closing cover 4 is attached to the first tube plate 2 and a second or upper annular closing cover 5 is attached to the second tube plate 3 with an outer screw joint 13*a* and inner screw joint 13*b*, c.f. also FIG. 2. The upper closing cover 5 is provided with a first connection 7 for an inlet of a first fluid, such as gas, and a second connection 8 for an outlet of the first fluid. The tubular shell 6 is provided with a third connection 9 for an inlet of a second fluid, such as a cooling media, and a fourth connection 10 for an outlet of the second fluid. An upper section of the heat exchanger 1 is provided with an outlet tube 11 through which gas can exit, should a tube break. A lid 12 with lid screw joints 14*a* closes the outlet tube 11 during normal operation.

Figure 2:
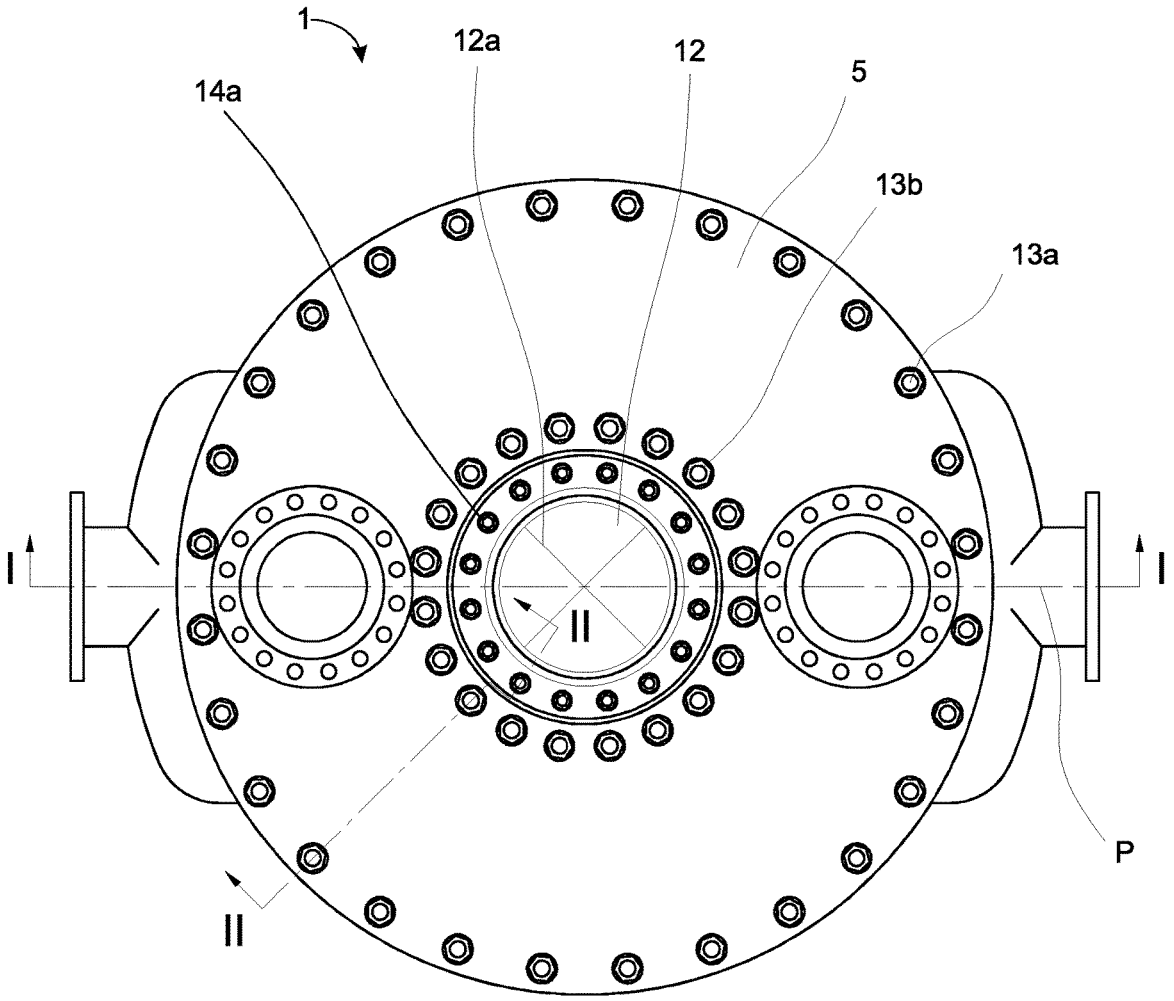
FIG. 2 is a top view of the embodiment shown in FIG. 1.

As shown in FIG. 2, a curved section of the lid 12 is formed with embossed indications of fracture 12*a* that will cause the lid 12 to break at a predetermined pressure. In various embodiments, safety valves are used instead. All connections are symmetrically arranged in an imaginary plane P extending through a center line C of the tubular shell 6.

Figure 3:
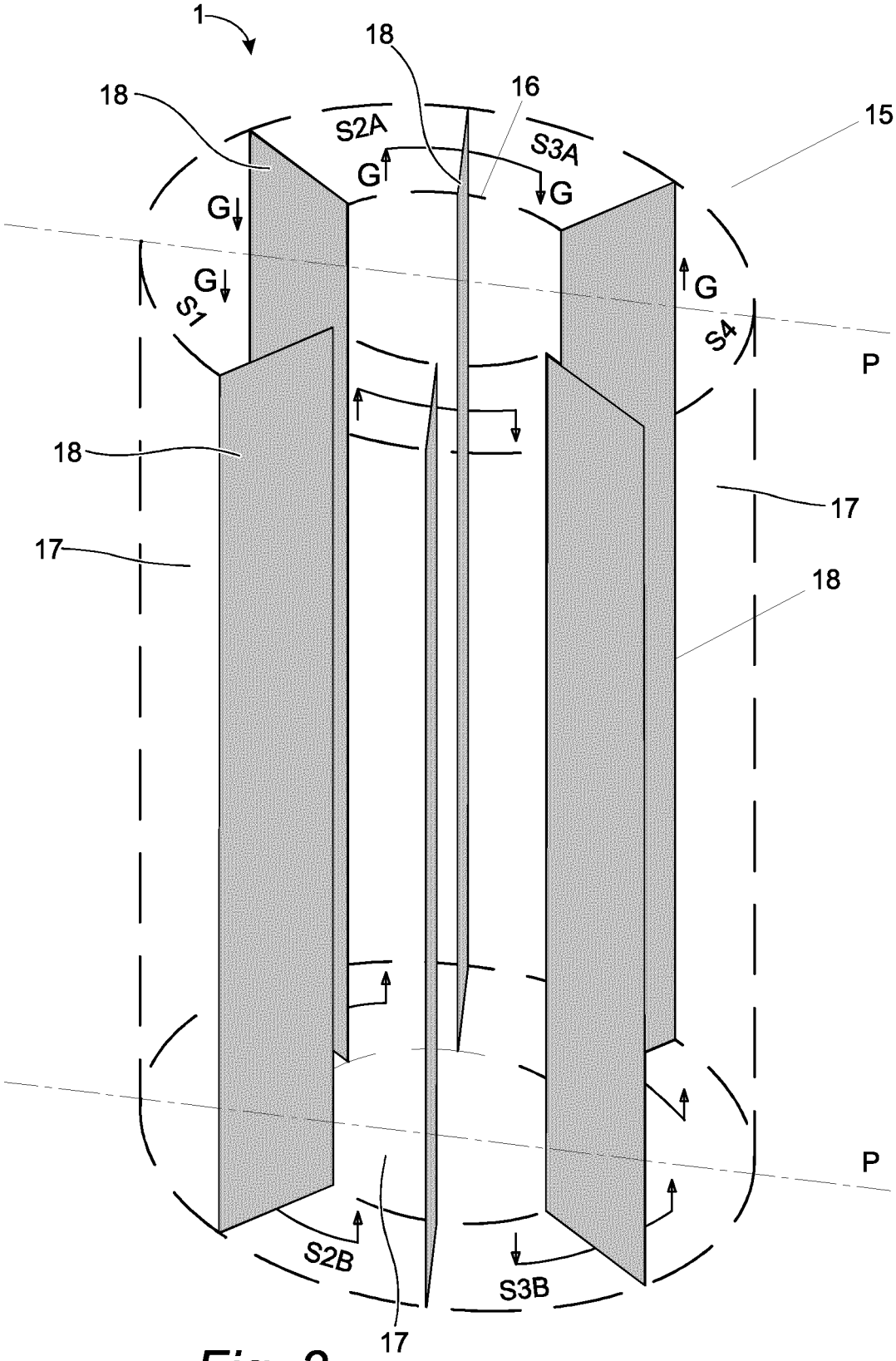
FIG. 3 is a schematic perspective view showing the heat exchange space of the tube heat exchanger in FIG. 1 with flow paths of a first fluid indicated.
Figure 4:
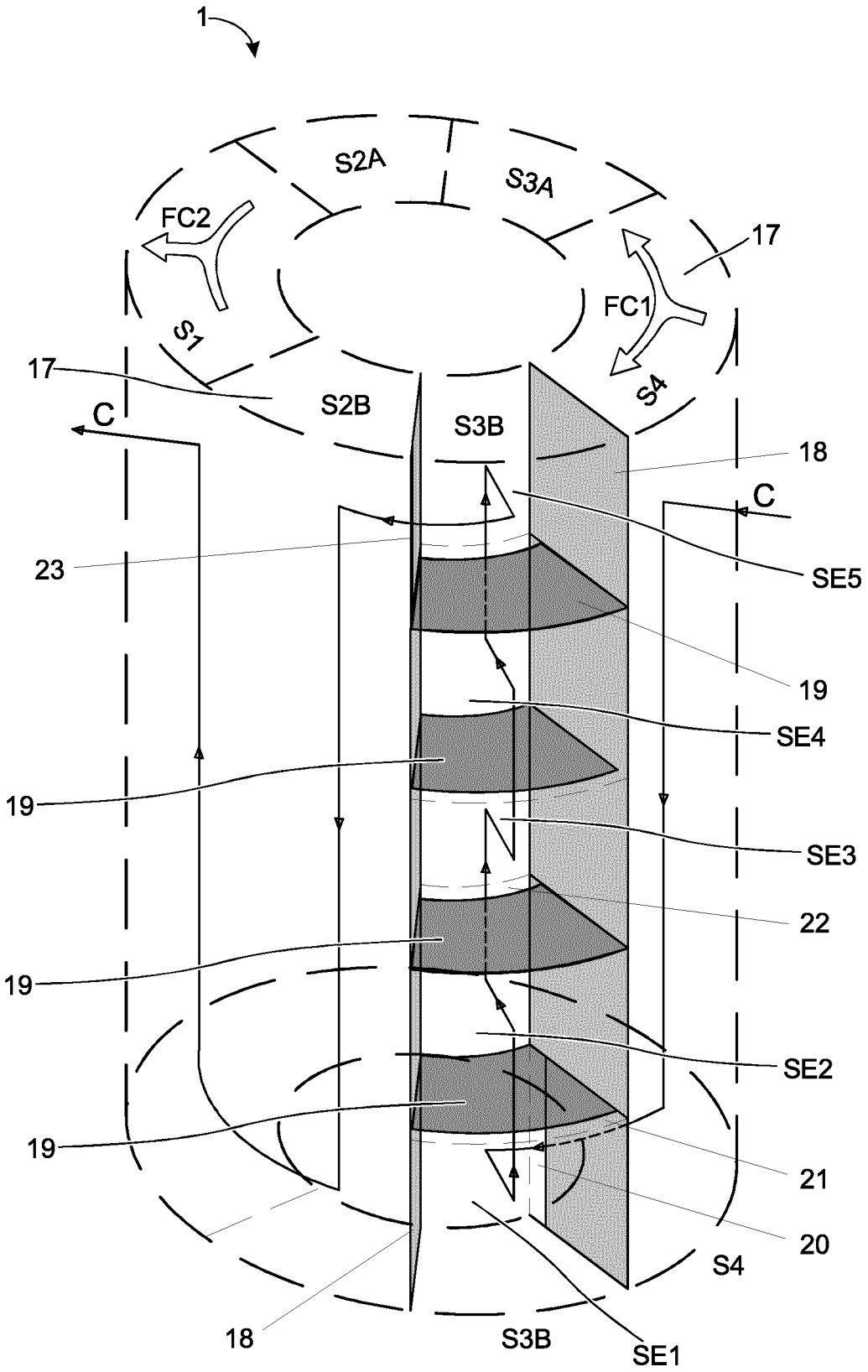
FIG. 4 is a schematic perspective view showing the heat exchange space of the tube heat exchanger in FIG. 1 with flow paths of a second fluid indicated.

FIG. 3 and FIG. 4 show schematically the basic structure of a heat exchange space in which the heat exchange takes place, and flow paths of the two fluids. The heat exchange space 15 is enclosed by the lower tube plate 2, the upper tube plate 3, the tubular shell 6 and a tubular inner wall 16 extending around the center line C. Thus, the heat exchange space 15 is an annular gap between the inner tubular wall 16 the tubular shell 6. The heat exchange space 15 is divided into six circular shaped heat exchange sectors 17. The inlet and outlet, respectively, of the fluids are provided at diametrically opposed heat exchange sectors 17. Each of these diametrically opposed heat exchange sectors 17 are considerably bigger than other sectors, so as to allow considerably higher flow rates. In various embodiments, these sectors 17 have a double size as compared to other sectors.

Figure 6:
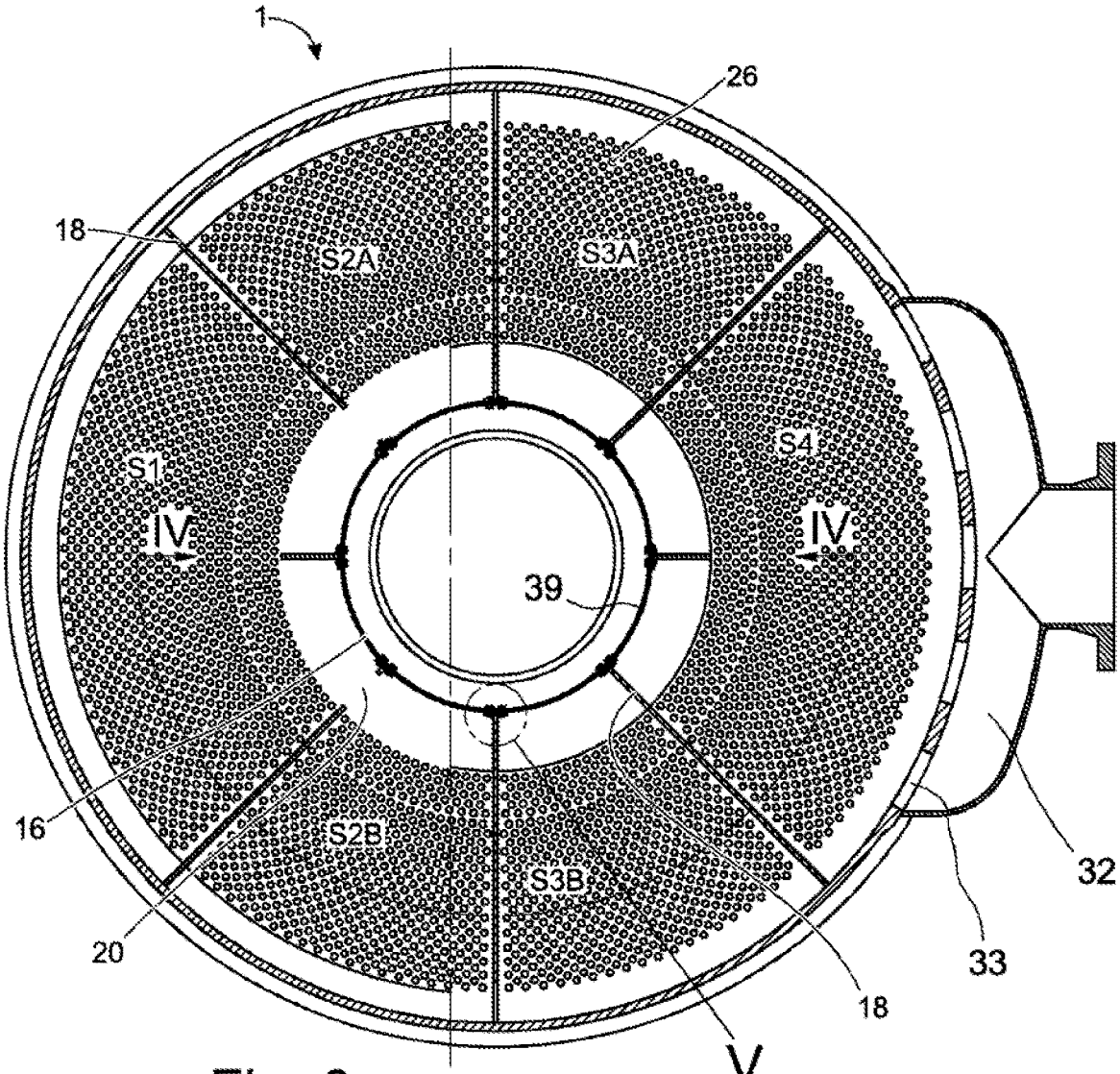
FIG. 6 is a cross sectional view from line III-Ill in FIG. 5 of the tube heat exchanger in FIG. 1.

FIG. 3 shows six radially extending separating walls 18 forming six sectors, S1, S2A, S2B, S3A, S3B and S4, c.f. also FIG. 6. The gas flow will enter the heat exchange space 15 through the inlet of the first connection 7 at an upper part of the sector S1 and will flow downwards. When the gas reaches a lower part of S1, it will be directed into the lower closing cover 4 where it is divided into two flow parts that are directed into the sectors S2A and S2B, respectively. The flow parts are substantially equal, and in various embodiments the flow parts have the same flow rate. The gas flows upwards as indicated in FIG. 3 through sectors S2A and S2B and then downwards through S3A and S3B, respectively, and finally through S4 and out through a first outlet duct 30 in the second connection 8 for outlet of gas. Arrows in FIG. 3 show the flow directions.

FIG. 4 shows how the cooling fluid flows through the sectors in opposite directions as compared to the gas. The cooling fluid enters the heat exchange space 15 in an upper area of S4 and flows downwards. In various embodiments, the flow of the cooling fluid is directed by baffles 19 in a crosscurrent flow to the flow of gas in a plurality of flow tubes 26. In this way, the transfer of heat between the gas and the cooling fluid will be very efficient. The baffles 19 and the flow path are shown more in detail in sector S3B. This sector is shown with four baffles 19 that direct the cooling fluid to flow radially between the flow tubes 26. The baffles 19 divide the sector S3B into five axially displaced segments SE1-SE5. Baffles 19 provided in each of the other sectors will divide the sector into axially displaced segments correspondingly. An arrow indicates the actual flow path. As shown in FIG. 4, the flow path of the cooling fluid will extend radially in opposite directions in adjacent heat exchange segments. A flow passage is provided between adjacent heat exchange segments to provide a flow path of the second fluid in a vertical direction between the adjacent heat exchange segments.

The cooling fluid will enter the sector S3B from the sector S4 through a first opening 20 in the radially extending separating wall 18 below a lower one of the baffles 19. There is a second opening 21 between the baffle 19 and the tubular shell 6 extending along the periphery of the tubular shell 6. The cooling fluid will be directed through the second opening 21 up into a space between the lower baffle and an adjacent baffle above the lower baffle. Between the following baffle and the inner wall 16 there is a third opening 22 extending along the periphery of the inner wall 16. The cooling fluid will be directed through the third opening 22 up into a space between the following baffle and a further adjacent baffle above. The second opening 21, the third opening 22 and optionally further openings will provide the flow path of the second fluid in a vertical direction between the adjacent heat exchange segments.

In a corresponding process, the cooling fluid flows further upwards to a space between an uppermost baffle 19 and the upper tube plate 3. The radially extending separating wall 18 is provided with a fourth opening 23 through which the cooling fluid will flow into the sector S2B. The main flow direction of the cooling fluid is from the bottom to the top in the sector S3B which is opposite to the main direction of the flow of the gas, c.f. FIG. 3, and from the top to the bottom in sector S2B. There are provided also further openings (not shown) in other radially extending separating walls 18, so as to allow the cooling fluid to flow into an adjacent heat exchange sector 17. The flow of the cooling fluid enters the heat exchange space 15 in an upper area of S4 and is separated into two flow paths as indicated by arrow FC1. The two flow paths will be united in sector S1, where the flow of the cooling fluid will exit from the heat exchange space 15 as indicated by arrow FC2. Other sectors are provided with baffles 19 similar to how they are provided in sector S3B, and the gas and the cooling fluid flow in opposite directions in all sectors. This is advantageous with respect to efficiency, should the energy in the heated cooling fluid be taken advantage of. At least one baffle 19 is used in the disclosed tube heat exchanger. The positioning and number of openings 20-22 and optionally further openings are chosen with respect to the number of baffles 19 to obtain a preferred flow path of the cooling fluid through the different segments.

Figure 5:
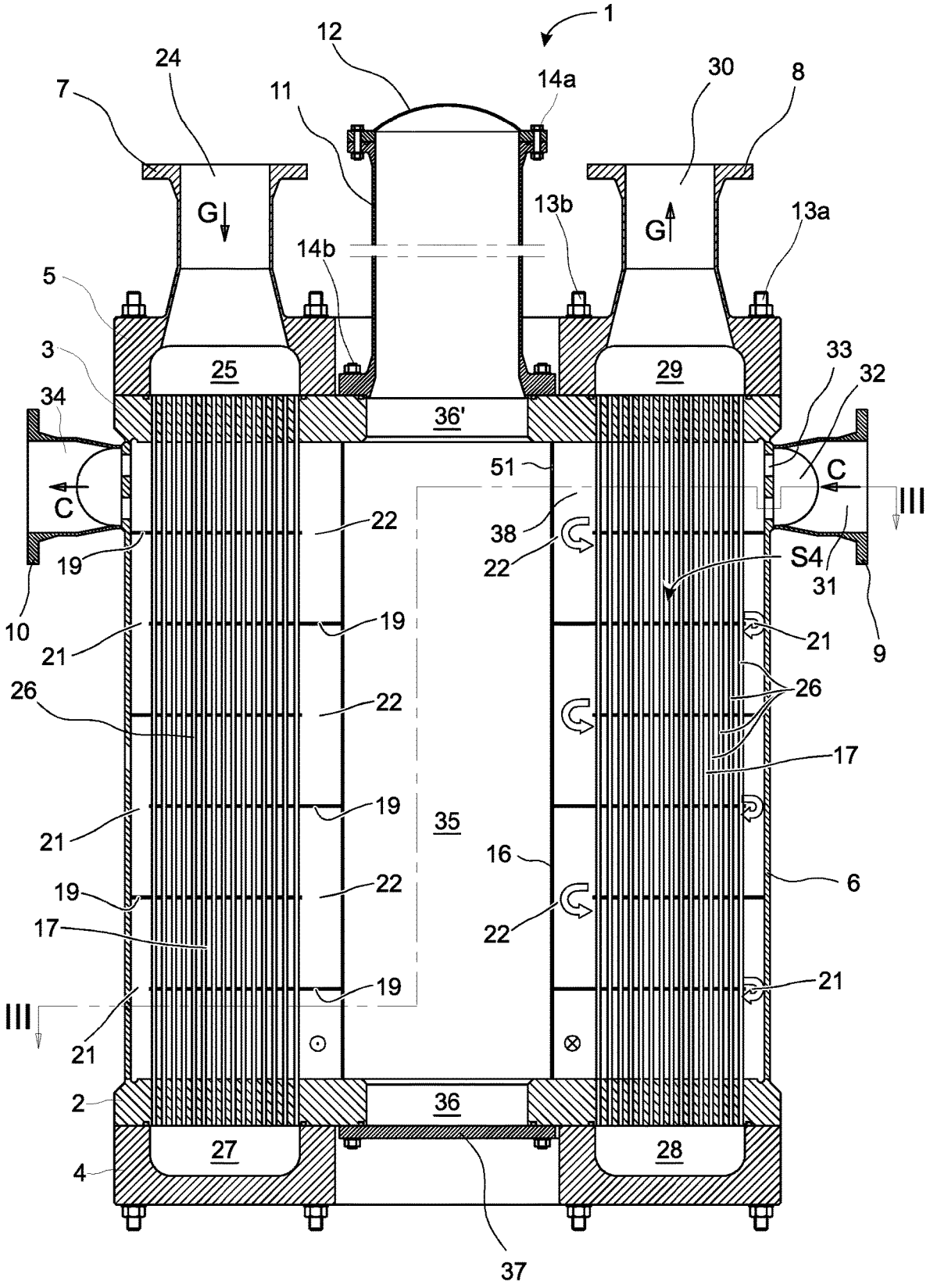
FIG. 5 is a longitudinal sectional view from line I-I in FIG. 2 of the tube heat exchanger in FIG. 1.

The cross sectional view in FIG. 5 from line I-I FIG. 2 coincides with the plane P. A first gas inlet duct 24 at the first connection 7 for inlet of gas directs the gas to a first chamber 25 in the upper closing cover 5 and further through the plurality of flow tubes 26 in the heat exchange sector S1 down to a first distributing chamber 27 in the lower closing cover 4 where the flow of gas is separated into two flows of gas. In various embodiments, the two flows of gas are equal. After passing through flow tubes of the sectors S2A and S3A and S2B and S3B, respectively, the two flows of gas will enter a second chamber 28. A common flow of gas then will flow through the flow tubes of heat exchange sector S4 to a third chamber 29 and further out through the first outlet duct 30 in the second connection 8 for outlet of gas.

A second inlet duct 31 in the third connection 9 for inlet of cooling fluid directs the cooling fluid into a fluid distributing chamber 32 and further through inlet openings 33 in the tubular shell 6 and into an uppermost and first heat segment of sector S4. As shown in FIG. 5, each sector is divided by six baffles 19 into seven segments. The cooling fluid will flow through the third opening 22 down into a lower segment and then radially towards the tubular shell 6. The cooling fluid will flow down through different segments of sector S4 and then through different sectors and out of the disclosed heat exchanger through a second outlet duct 34 at the fourth connection 10 for outlet of cooling fluid as described above with reference to FIG. 4.

In the center of the disclosed heat exchanger there is provided a central chamber that is connected to a lower opening 36 and an upper opening 36' of the lower tube plate 2 and the upper tube plate 3, respectively. The lower opening 36 is closed with a bottom lid 37. An outlet tube 11 for the gas is provided at the upper opening 36'. The outlet tube 11 is connected to the upper tube plate 3 with a set of tube screw joints 14*b*. The inner wall 16 is provided with an aperture 51 at an inlet area 38 for the cooling fluid. As a result, the central chamber 35 will be filled with cooling fluid and the pressure inside the central chamber 35 will be the same or higher than the pressure outside the central chamber 35.

FIG. 6 shows a cross section III-Ill in FIG. 5. The disclosed heat exchanger is symmetrically arranged around the plane P that cuts through all connections. As disclosed above, the heat exchanger is provided with six radially extending walls 18 forming the six sectors, S1, S2A, S2B, S3A, S3B and S4. In this embodiment, there are three radially extending walls 18 on either side of the plane P. Thus, the medias will pass through four sectors. In the embodiment shown in FIG. 6, the inner wall 16 comprises eight panels 39 that are retained by screws 40 or stud bolts 52 and nuts 54. The area depicted V in FIG. 6 is shown enlarged in FIG. 7*a* and FIG. 7*b*. The number of panels 39 can be more or less than in the shown embodiment, such as ten or six panels 39, and the panels 39 can be flat, or curved as indicated in FIG. 6 and FIG. 7.

Figure 7A:
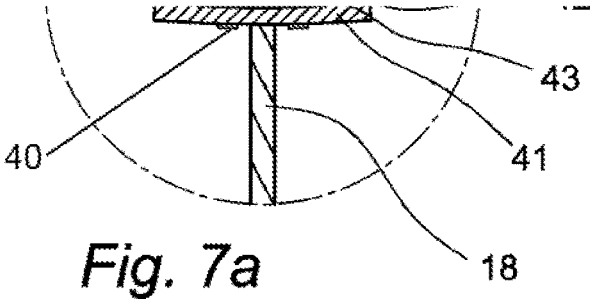
FIG. 7*a* shows an area V of FIG. 6 of a first embodiment in greater detail.

In the embodiment shown in FIG. 7*a*, the panels 39 are attached by the screws 40 along edges thereof to flanges 41 that are welded to the radially extending separating walls and to inner edges of connecting baffles 19. In various embodiments, other attachment means, such as stud bolts, rivets or other connections are used. Since there is a higher pressure in the central chamber 35 than in the heat exchange space 15 due to a pressure drop in the heat exchange space 15 there will be pressure load on the panels 39. In various embodiments, the panels 39 are curved and the load will cause only membrane stress during normal conditions. As a result, comparatively thin material can be used. Tangential forces will be carried by a strip 42 that is fixedly mounted to the edges of the curved panels, such as by welding. The screws 40 will secure the curved panels and compress a gasket 43, so as to minimize leakage between the central chamber 35 and the heat exchange space 15. Should there be tube breakage causing a major leakage of gas, the pressure in the heat exchange space 15 will increase over a level where the curved panels will burst or come loose and release gas into the central chamber 35. A required differential pressure for the release of gas can be predetermined by adjusting the breaking load and number of screws 40.

Figure 7B:
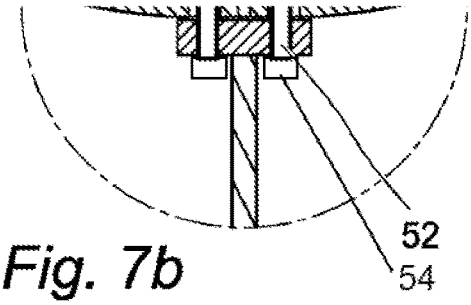
FIG. 7*b* shows an area V of FIG. 6 of an alternative embodiment in greater detail.

In the embodiment shown in FIG. 7*b*, the screws are replaced by the stud bolts 52 and the nuts 54. In this embodiment, the nuts have a comparatively low strength limit. When there is a leakage of gas, there will be a shear failure in the threads of the nuts 54 and the panels will come loose allowing the gas to exit from the tube heat exchanger. Still, the panels 39 as well as the stud bolts 52 will remain intact and can be used again. In this embodiment, the panels 39 are thicker which will provide in a higher bending strength. As a result, the panels will be sufficiently rigid to carry the pressure load. Thus, no further arrangements are required to absorb any membrane stresses.

Figure 8:
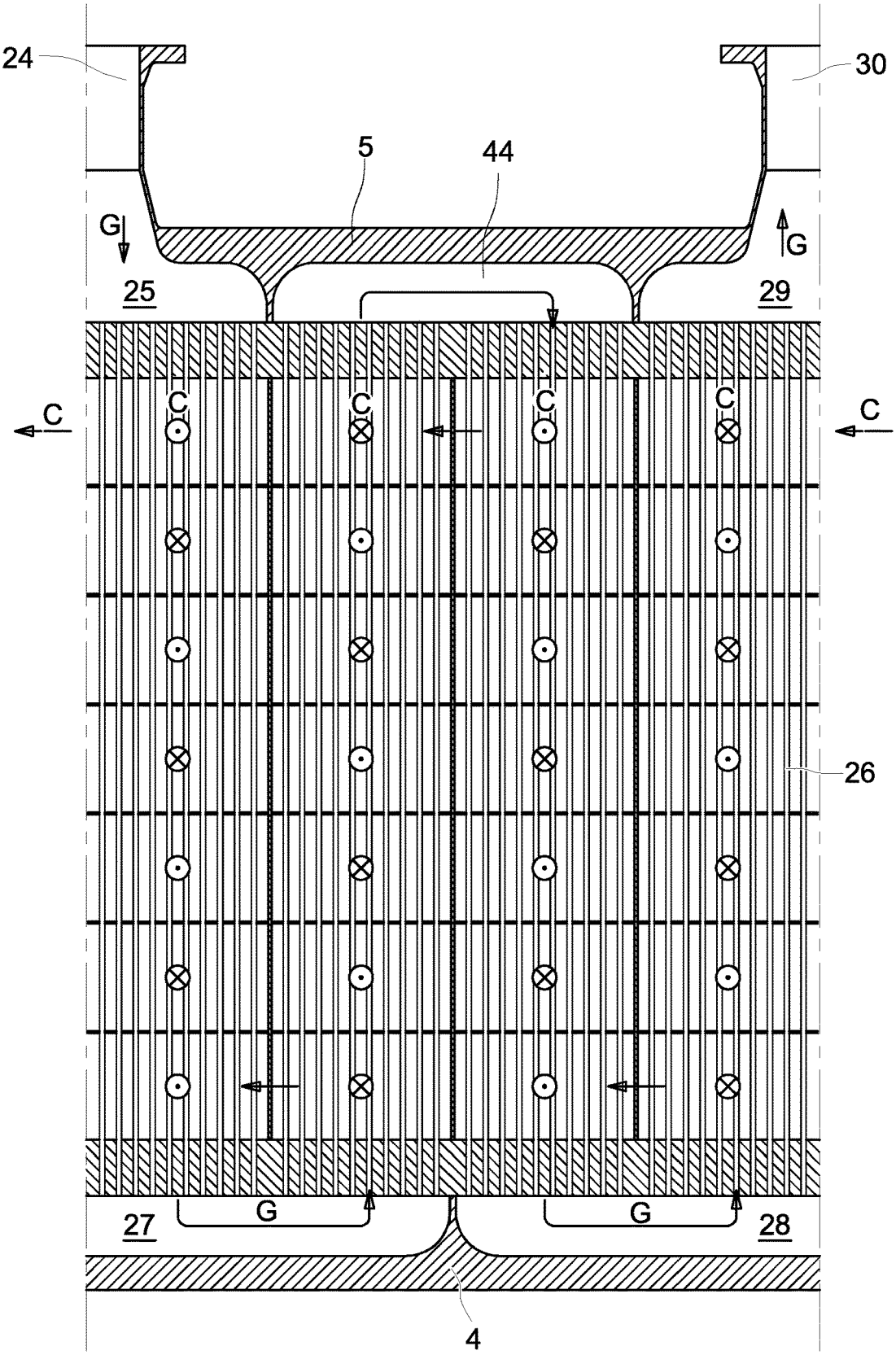
FIG. 8 is a longitudinal sectional view from line IV-IV in FIG. 6 of the tube heat exchanger in FIG. 1 as seen perpendicular to the line IV-IV.

FIG. 8 is a cross sectional view through the complete heat exchanger as seen perpendicularly to line IV-IV of FIG. 6. The flow path of the cooling fluid is depicted by arrows C and circles with either a cross or a dot. A cross indicates that the flow direction is towards the center while a dot indicates that the flow direction is out from the center. The flow direction of the gas is marked at the first gas inlet duct 24 and the first outlet duct 30, and the first chamber 25, the first gas distributing chamber 27, the second gas distributing chamber 28, a third gas distributing chamber 44 and the second chamber 29 of the lower closing cover 4 and the upper closing cover 5.

Figure 9:
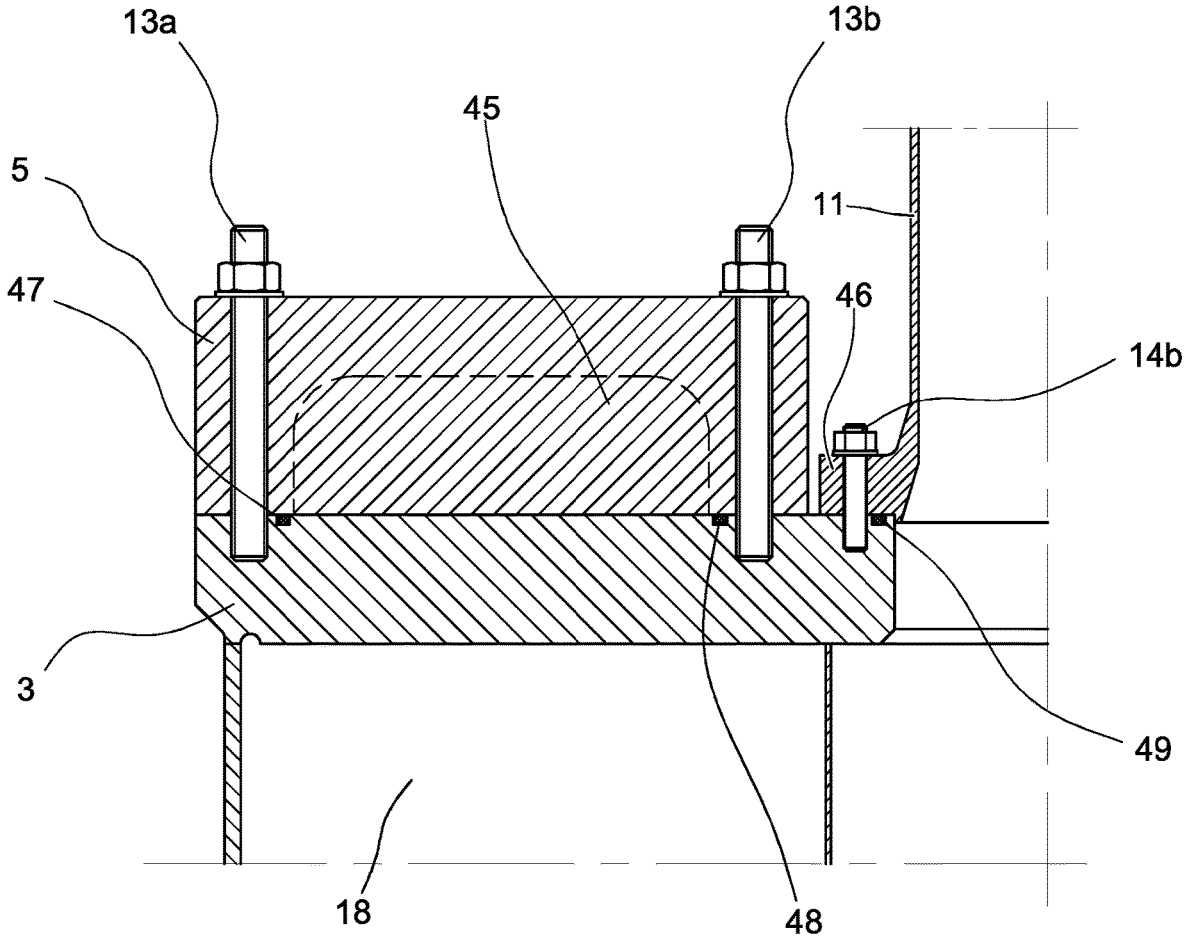
FIG. 9 is a longitudinal sectional view from line II-II in FIG. 2 of an upper section of the tube heat exchanger in FIG. 1.

FIG. 9 is a cross section of an upper part from line II-II of FIG. 2. The figure shows that threaded pins of the outer screw joints 13*a*, the inner screw joints 13*b* and the tube screw joints 14*b* of the outlet tube 11 are mounted in threaded dead end holes in the upper tube plate 3 and extend up through the upper closing cover 5 and a tube flange 46. The cross section II-II cuts through a partition 45 between the first chamber 25 and the third gas distributing chamber 44 in the upper closing cover 5 and the radially extending separating wall 18 between the sectors 51 and 52B, c.f. FIG. 3. Gas sealing rings 47 and 48 seals off the gas, and a fluid sealing ring 49 forms a barrier for the cooling fluid.

Figure 10:
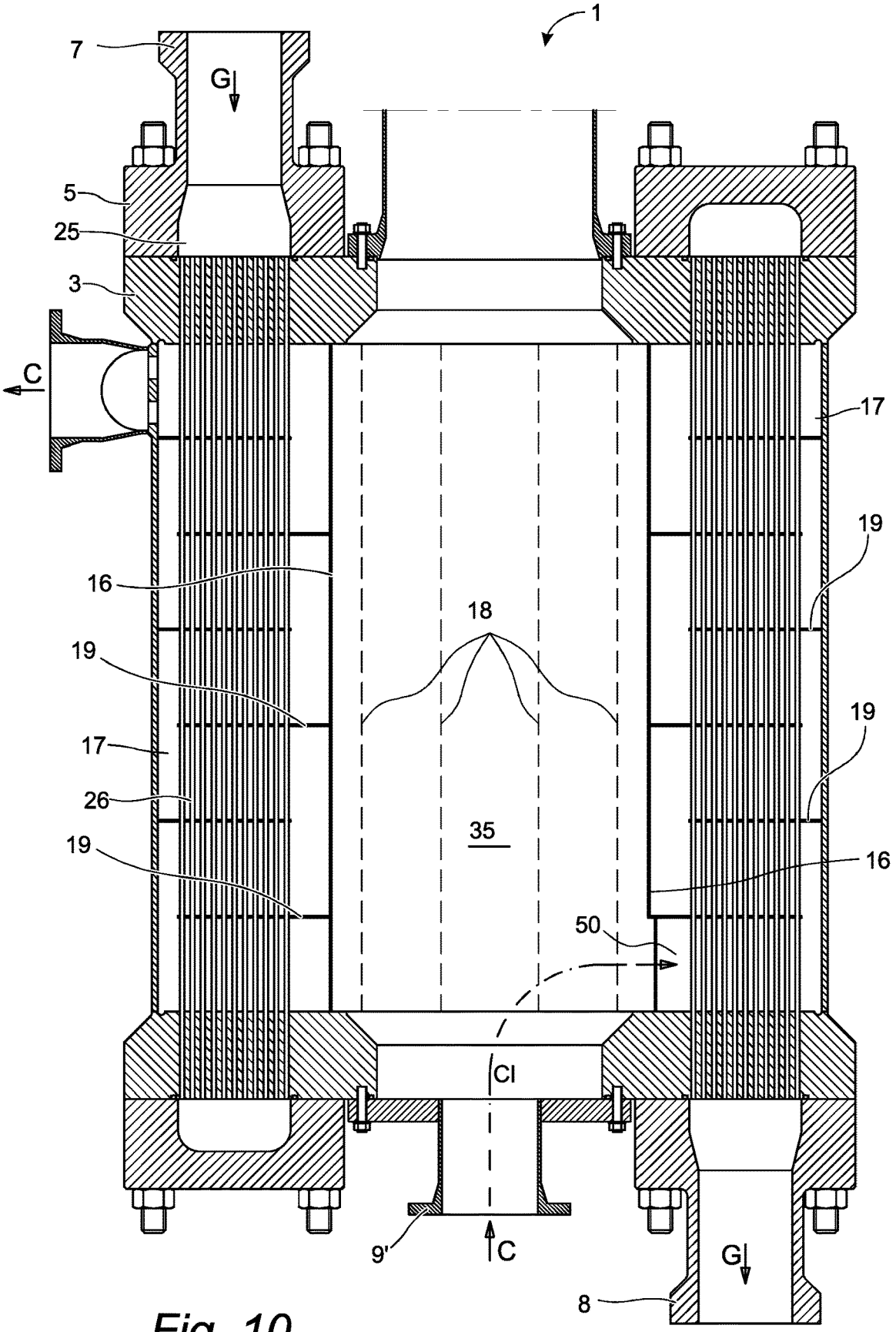
FIG. 10 is a longitudinal sectional view of a second embodiment of flow paths of a tube heat exchanger.
Figure 11:
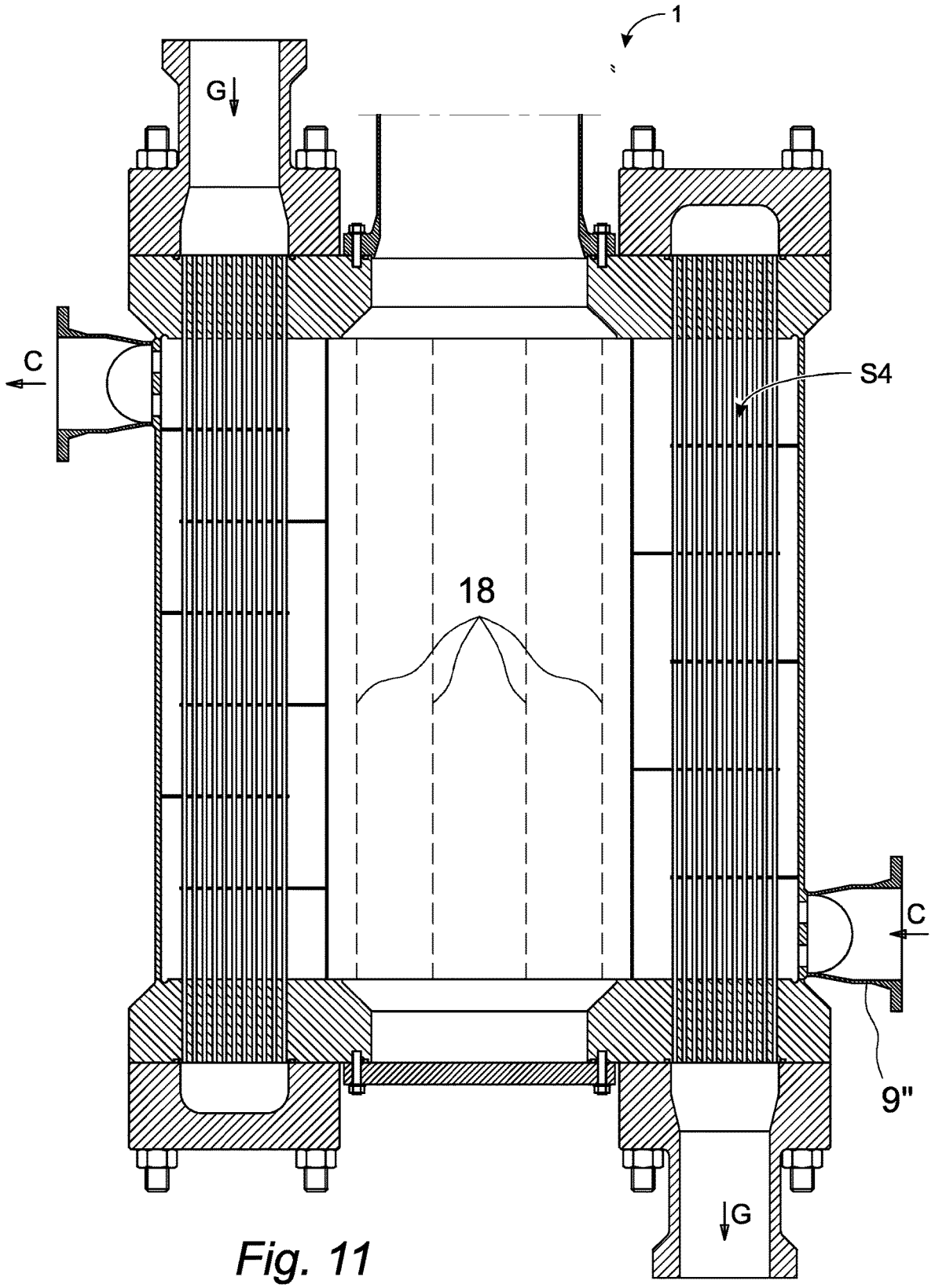
FIG. 11 is a longitudinal sectional view of a third embodiment of flow paths of a tube heat exchanger.

The number of radially extending separating walls 18 and the number of baffles 19 will determine how different connections are arranged in relation to each other. FIG. 10 and FIG. 11 disclose alternative embodiments for inlets and outlets of the gas and the cooling fluid. If the number of radially extending separating walls 18 on each side of the imaginary plane P is uneven the first connection 7 for inlet of gas and the second connection 8 for outlet of gas will be located at the same end of the heat exchanger, as shown in FIG. 5. The embodiment of the heat exchanger 1 shown in FIG. comprises four radially extending separating walls 18 and six baffles 19 in each heat exchange sector 17. This is the same number of baffles 19 as in the embodiment shown in FIG. 5, and as a result, the cooling fluid is directed into the heat exchange sector 17 through a fifth opening 50 in the inner wall 16. In this embodiment, the cooling fluid is conveyed into the heat exchanger 1 through a third connection inlet 9' in the bottom lid 37. The cooling fluid is directed from the third connection inlet 9', and through the central chamber 35 and the fifth opening 50 into one of the heat exchange sectors 17, as indicated by arrow Cl.

In the embodiment shown in FIG. 11, there are provided only five baffles 19 in the heat exchange sector S4 where the cooling fluid is entering the heat exchanger 1. A fourth connection inlet 9" is provided in the tubular shell 6 to secure a consistent flow of cooling fluid throughout the heat exchange sector S4.

Figure 12:
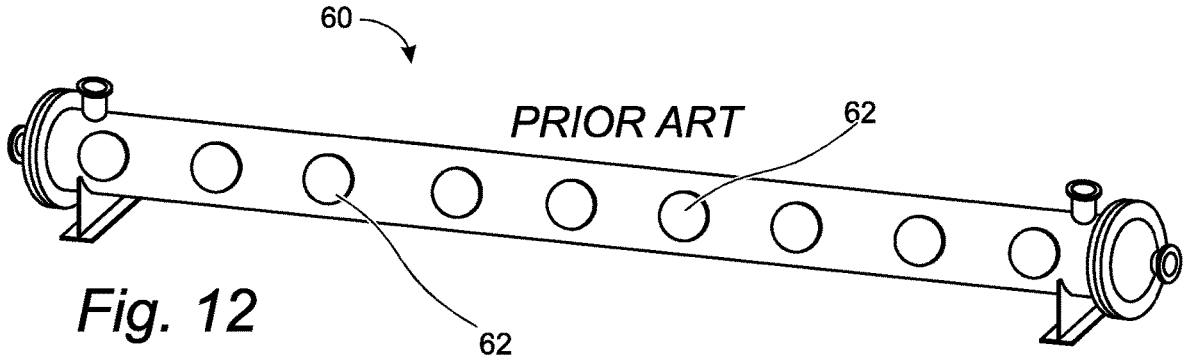
FIG. 12 is schematic perspective view of a prior art tube heat exchanger.

FIG. 12 shows schematically a prior art tube heat exchanger 60 with a cylindrical outer shape. Many prior art exchangers there is an even bigger relationship between a length and a diameter of the heat exchanger. Prior art heat exchangers can have length that is ten times longer than the diameter. Normally, a safety zone around prior art tube heat exchanger is required. Normally, there are provided a plurality of axially displaced safety covers 62. The safety covers 62 will open up to allow high pressure fluids to flow out from the heat exchanger mainly in a horizontal direction. Safety regulations require a considerably large restricted use area around the heat exchanger.

The various embodiments described above are provided by way of illustration only and should not be construed to limit the invention. For example, the principles herein may be applied to any tube heat exchanger. Those skilled in the art will readily recognize various modifications and changes that may be made to the present invention without following the example embodiments and applications illustrated and described herein, and without departing from the scope of the present disclosure.

The invention claimed is:

1. A tube heat exchanger for exchanging heat from a first fluid to a second fluid, comprising a tubular shell;

an inner wall extending around a center axis of the tubular shell and forming a central chamber internally of the inner wall, and an annular heat exchange space extending externally of the inner wall and enclosed by the tubular shell, wherein the heat exchange space includes a plurality of axially extending heat exchange sectors separated by radially extending separating walls, and flow paths of the first fluid and the second fluid extend in the heat exchange space, wherein adjacent heat exchange sectors are in fluid communication;

a set of flow tubes extending axially in each of the heat exchange sectors in the heat exchange space;

a first connection for inlet of the first fluid to a first set of flow tubes, and a second connection for outlet of the first fluid;

at least one radially extending baffle dividing the heat exchange sectors into at least two axially displaced heat exchange segments, wherein the central chamber communicates with at least one opening in a tubeplate, and wherein a flow passage is provided between adjacent heat exchange segments to provide a flow path of the second fluid in a vertical direction between the adjacent heat exchange segments;

a third connection for inlet of the second fluid to a first heat exchange segment of a heat exchange sector, and a fourth connection for outlet of the second fluid;

wherein a first flow path of the first fluid and a second flow path of the second fluid are divided to flow by a first portion clockwise and a second portion anti-clockwise through the axially extending heat exchange sectors;

wherein a flow path of the second fluid extends radially in opposite directions in adjacent heat exchange segments in the heat exchange sectors, and a flow path of the first fluid extends perpendicular to the flow path of the second fluid.

2. The tube heat exchanger as claimed in claim 1, wherein the first connection, the second connection, the third connection and the fourth connection are arranged in an imaginary plane P extending through and parallel to a center line C of the tubular shell.

3. The tube heat exchanger as claimed in claim 1, wherein first openings are provided in the radially extending separating walls to allow a flow of the second fluid to pass through from one heat exchange sector to an adjacent heat exchange sector.

4. The tube heat exchanger as claimed in claim 3, wherein the annular heat exchange space is enclosed by the tubular shell, the inner wall, a first tube plate, and a second tube plate.

5. The tube heat exchanger as claimed in claim 4, wherein the first openings extend vertically between the first tube plate and an adjacent baffle, and between the second tube plate and an adjacent baffle.

6. The tube heat exchanger as claimed in claim 1, wherein second openings extending along the periphery of the tubular shell are provided between baffles and the tubular shell, and third openings extending along the periphery of the inner wall are provided between baffles and the inner wall, the second openings and the third openings providing a flow path of the second fluid in a vertical direction between the axially displaced heat exchange segments in a heat exchange sector.

7. The tube heat exchanger as claimed in claim 1, wherein the heat exchange sector provided with the first set of flow tubes is substantially twice as big as adjacent heat exchange sectors.

8. The tube heat exchanger as claimed in claim 1, comprising a first chamber connecting a flow of flow tubes of the first set of flow tubes, a first distributing chamber connecting a flow path of the first fluid between two adjacent heat exchange sectors, a second distributing chamber connecting a flow path of the first fluid between two further adjacent heat exchange sectors, and a second chamber connecting a flow of flow tubes of a last set of flow tubes, wherein the second chamber is connected to a first outlet duct in the second connection for outlet of the first fluid.

9. The tube heat exchanger as claimed in claim 1, wherein the tubular shell is enclosed by a first annular closing cover at a first end and a second annular closing cover at an opposite end.

10. The tube heat exchanger as claimed in claim 9, wherein the annular heat exchange space is enclosed by the tubular shell, the inner wall, a first tube plate, and a second tube plate; and wherein the first and the second tube plates are respectively connected to the first and the second annular closing covers by bolts along outer and inner edges.

11. The tube heat exchanger as claimed in claim 1, wherein the inner wall is provided with an aperture that connects the annular heat exchange space and the central chamber.

12. The tube heat exchanger as claimed in claim 11, wherein the inner wall is arranged in such way that fluid can pass from the heat exchange space to the central chamber if the pressure in the heat exchange space exceeds a predetermined pressure level.

13. The tube heat exchanger as claimed in claim 12, wherein the inner wall has a breaking strength that is lower or equal to a proof pressure of the tubular shell.

14. The tube heat exchanger as claimed in claim 13, wherein the inner wall comprises a plurality of panels interconnected by flanges.

15. The tube heat exchanger as claimed in claim 14, wherein the flanges and panels are connected by bolted joints; and wherein a breaking strength of the inner wall is determined by adjusting a holding force and number of bolted joints connecting the flanges and the panels.

16. The tube heat exchanger as claimed in claim 1, wherein the central chamber communicates with at least one heat exchange segment.

* * * * *